US005498155A

United States Patent [19]

Chyou et al.

[11] Patent Number: 5,498,155

[45] Date of Patent: Mar. 12, 1996

[54] MIXING AND FLAME STABILIZATION APPLIANCE IN A COMBUSTION CHAMBER WITH PREMIXED COMBUSTION

[75] Inventors: Yau-Pin Chyou, Taipei, Taiwan; Adnan Eroglu, Untersiggenthal, Switzerland

[73] Assignee: ABB Management AG, Baden, Switzerland

[21] Appl. No.: 225,390

[22] Filed: Apr. 8, 1994

[30] Foreign Application Priority Data

Apr. 8, 1993 [CH] Switzerland ..... 01 087/93

[51] Int. Cl.[6] ..... F23D 14/46

[52] U.S. Cl. ..... 431/350; 431/351; 431/354; 431/182; 431/185

[58] Field of Search ..... 431/354, 350, 431/185, 182, 351; 60/737, 743, 749

[56] References Cited

U.S. PATENT DOCUMENTS

| | | | |
|---|---|---|---|
| 1,022,493 | 4/1912 | Meigs . | |
| 1,454,196 | 5/1923 | Trodd . | |
| 1,466,006 | 8/1923 | Trodd . | |
| 3,051,452 | 8/1962 | Nobel . | |
| 3,404,869 | 10/1968 | Harder . | |
| 3,974,646 | 8/1976 | Markowski et al. | 60/737 |
| 4,164,375 | 8/1979 | Allen | 366/337 |
| 5,340,306 | 8/1994 | Keller et al. | 431/351 |
| 5,423,608 | 6/1995 | Chyou et al. | 366/337 |
| 5,433,596 | 7/1995 | Döbbeling et al. | 431/350 |

FOREIGN PATENT DOCUMENTS

| | | |
|---|---|---|
| 3520772 | 12/1986 | Germany . |
| 3534268 | 4/1987 | Germany . |

*Primary Examiner*—Larry Jones
*Attorney, Agent, or Firm*—Burns, Doane, Swecker & Mathis

[57] ABSTRACT

In a mixing and flame stabilization appliance in a combustion chamber with premixed combustion, a gaseous and/or liquid fuel is introduced into the combustion air. The combustion air is guided via a plurality of vortex generators (9) arranged adjacent to one another over the width or the periphery of the combustion chamber duct (20) through which flow takes place. Fuel is introduced into the duct (20) in the immediate region of the vortex generators (9). A vortex generator (9) has three surfaces around which flow can take place freely, which surfaces extend in the flow direction, one forming the top surface (10) and the two others forming the side surfaces. The side surfaces enclose between them a V-angle (a) varying in the flow direction and the top surface (10) is disposed at an angle of incidence to the duct wall (21 ) which varies in the flow direction. Thorough mixing of the combustion air and the fuel can be achieved within the shortest distance by means of such vortex generators and the flame can be aerodynamically stabilized at the same time.

15 Claims, 4 Drawing Sheets

FIG. 1a
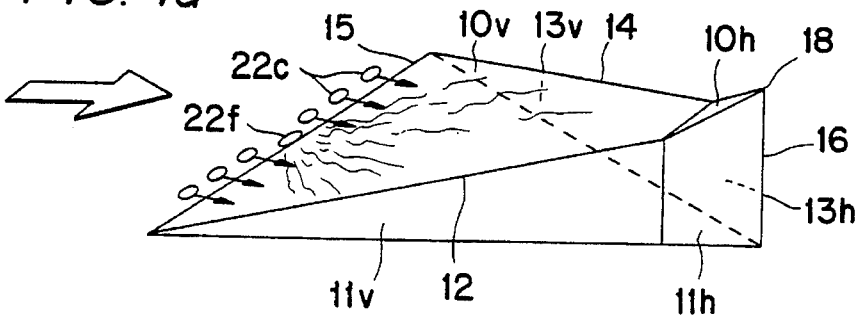
FIG. 1b
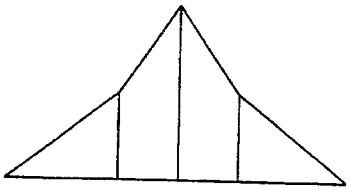
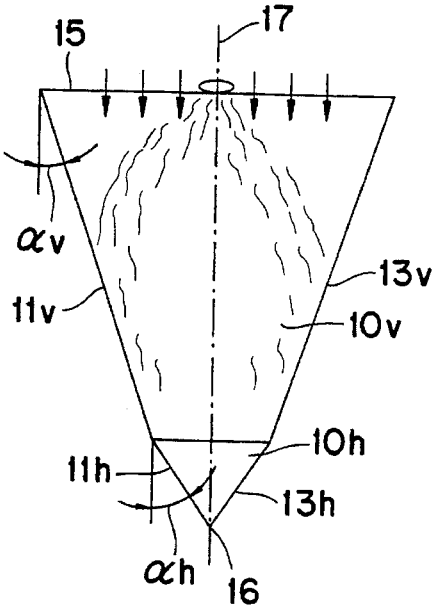
FIG. 1c
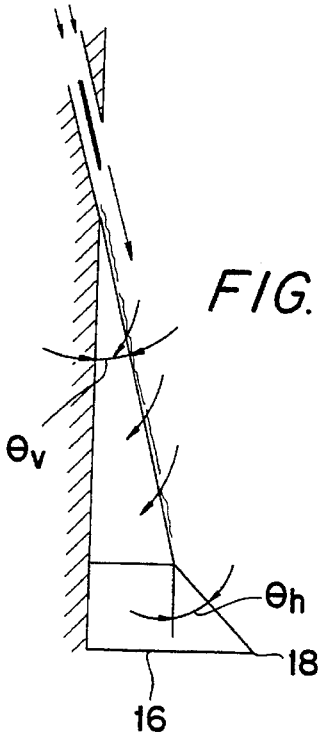
FIG. 1d
FIG. 3
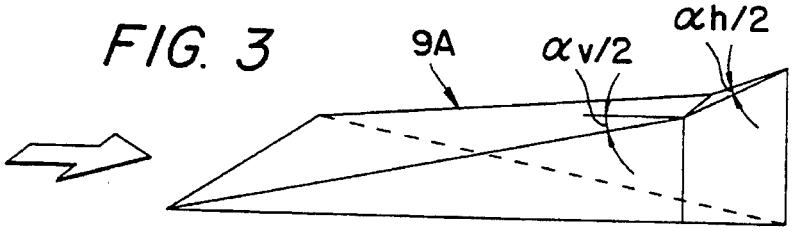

FIG. 6a
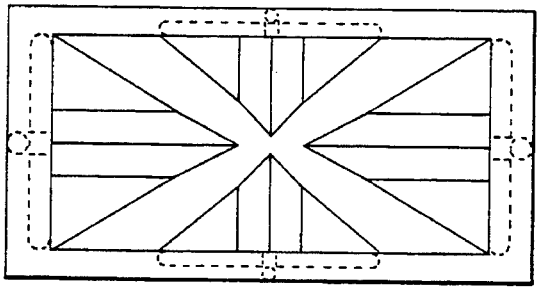
FIG. 6b
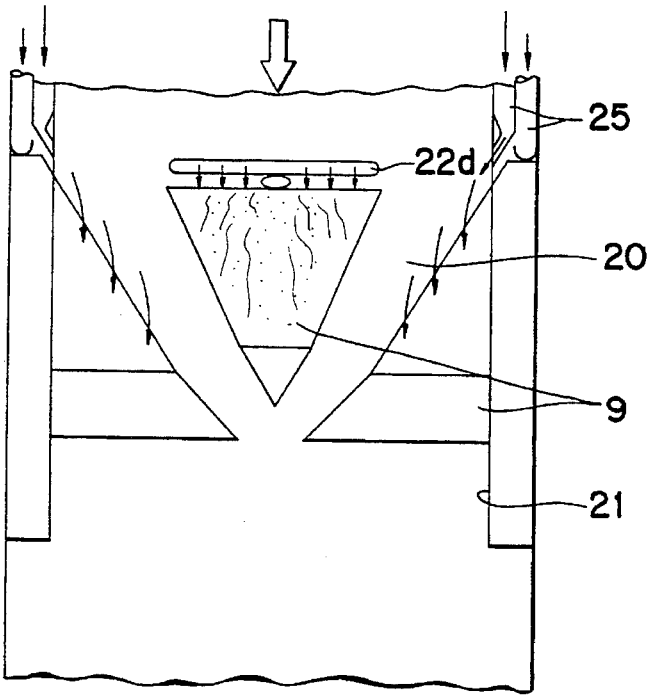
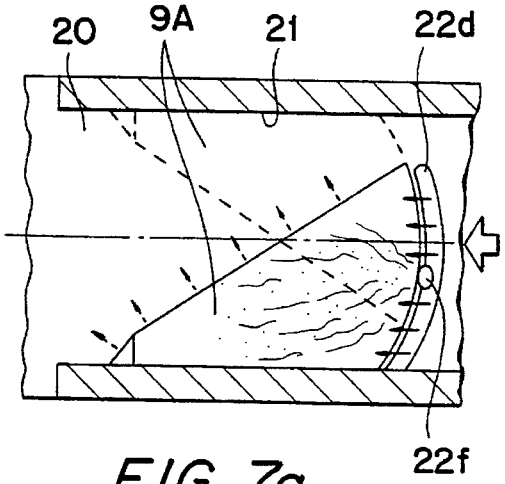
FIG. 7a
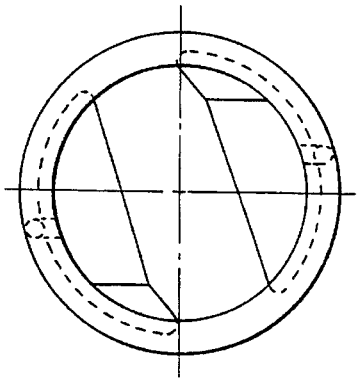
FIG. 7b

FIG. 8
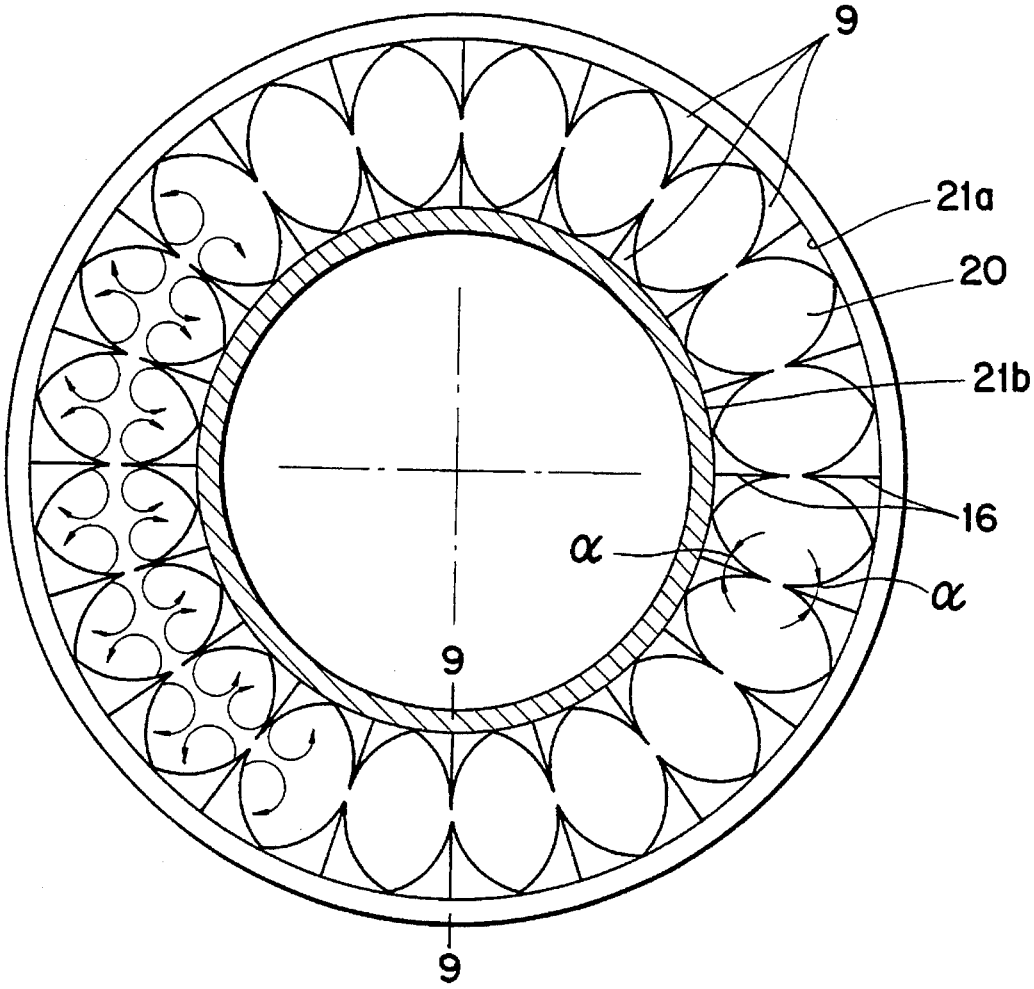
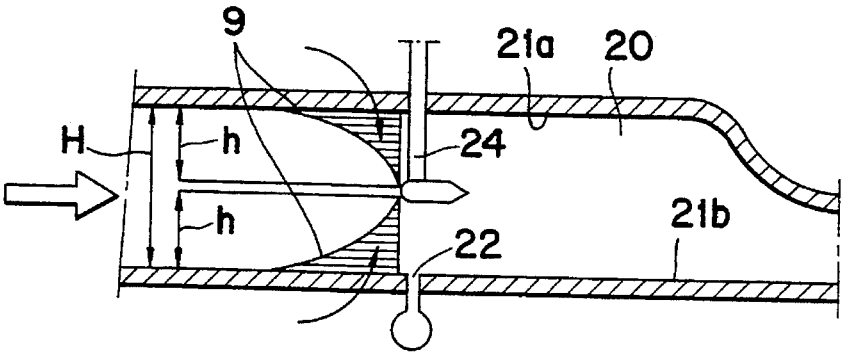
FIG. 9

MIXING AND FLAME STABILIZATION APPLIANCE IN A COMBUSTION CHAMBER WITH PREMIXED COMBUSTION

BACKGROUND OF THE INVENTION

1. Field of the Invention

The invention relates to a mixing and flame stabilization appliance in a combustion chamber with premixed combustion in which a gaseous and/or liquid fuel is introduced into the combustion air.

2. Discussion of Background

In terms of low emission, premixed combustion requires extraordinarily good mixing of the combustion air and the fuel.

Cold streaks can be found in the main flow in combustion chambers and these can, for example, occur due to the introduction of cooling air into the combustion air. Such streaks can lead to inadequate burn-out in the combustion zone. Measures have therefore to be taken in order to mix the combustion air, cooling air and fuel thoroughly. The mixing of a secondary flow with a main flow which is present in a duct generally takes place by the radial introduction of secondary flow into the duct. The momentum of the secondary flow is then so small that almost complete mixing only occurs after a length of approximately 100 duct heights.

SUMMARY OF THE INVENTION

Accordingly, one object of the invention is to provide, in a combustion chamber with premixed combustion, a novel measure by means of which thorough mixing of the combustion air and fuel is achieved within the shortest distance and by means of which the flame can be aerodynamically stabilized at the same time.

This is achieved in the invention, wherein the combustion air is guided by means of vortex generators of which a plurality are arranged adjacent to one another over the width or the periphery of the combustion chamber duct through which flow takes place and wherein the fuel is introduced into the duct in the immediate region of the vortex generators, wherein a vortex generator has three surfaces around which flow can take place freely, which surfaces extend in the flow direction, one of them forming the top surface and the two others forming the side surfaces, wherein the side surfaces abut the same duct wall and enclose between them a V-angle $\alpha$ which varies in the flow direction, wherein a top surface edge extending transversely to the duct through which flow takes place is in contact with the same duct wall as the side walls, wherein the longitudinally directed top surface edges, which abut the longitudinally directed side surface edges protruding into the flow duct, extend at an angle of incidence $\Theta$ to the duct wall, which angle varies in the flow direction, and wherein the two side surfaces enclosing the V-angle $\alpha$ include between them a connecting edge which, together with the longitudinally directed edges of the top surface, forms a point.

Using the novel static mixer, which is represented by the vortex generators, it is possible to achieve extraordinarily short mixing distances with a simultaneously low pressure loss. Rough mixing of the two flows has already been completed after one full revolution of the vortex whereas fine mixing, as a consequence of turbulent flow and molecular diffusion processes, is present after a distance which corresponds to a few duct heights.

The advantage of the vortex generators according to the invention may be seen in the particular simplicity of the element in every respect. From the point of view of manufacture, the element consisting of three walls around which flow takes place is completely unproblematic. The top surface can be joined to the two side surfaces in various ways. The fixing of the element onto flat or curved duct walls can moreover take place by means of simple welds in the case of weldable materials. From the point of view of fluid mechanics, the element has very low pressure loss when flow takes place around it and it generates vortices without a dead water region. Finally, the element can be cooled in different ways and with various means because its internal space is generally hollow.

For the present applications, it is expedient for the angle of incidence $\Theta$ of the top surface and/or the V-angle $\alpha$ of the side surfaces to be selected in such a way that the vortex generated by the flow has already broken down in the region of the vortex generator. The possible variation of the two angles provides a simple aerodynamic stabilization means which is independent of the cross-sectional shape of the duct through which flow takes place. This duct can be either wide and low or narrow and high and can be provided with flat or curved duct walls.

It is useful for the two side surfaces which include the V-angle $\alpha$ to be arranged symmetrically about an axis of symmetry. Vortices with the same swirl strength are generated by this means.

If the two side surfaces enclosing the V-angle $\alpha$ form an at least approximately sharp connecting edge with one another, the flow cross-section is practically unimpaired by blockage.

If the sharp connecting edge is the outlet edge of the vortex generator and if it extends at right angles to the duct wall on which the side surfaces abut, the non-formation of a wake region is of advantage. A vertical connecting edge also leads to side surfaces which are likewise at right angles to the duct wall, which gives the vortex generator the simplest possible shape and the shape most favorable from the point of view of manufacture.

It is appropriate to select the ratio between the height h of the connecting edge of the two side surfaces and the duct height H in such a way that the vortex generated fills the complete duct height, or the complete height of the duct part associated with the vortex generator, directly downstream of the vortex generator. The large-scale vortices generated ensure that the same velocity distribution is present in each plane behind the vortex generator.

A plurality of vortex generators are advantageously arranged adjacent to one another without intermediate spaces over the width of the duct through which flow takes place. This measure ensures that the complete duct cross-section is fully acted on by the vortices shortly after the vortex generators.

If the axis of symmetry extends parallel to the duct axis and the connecting edge of the two side surfaces forms the downstream edge of the vortex generator, whereas the top surface edge extending transversely to the duct through which flow takes place is the edge which the duct flow meets first, two equal and opposed vortices are generated on one vortex generator. A neutral-swirl flow pattern is present in which the direction of rotation of the two vortices rises in the region of the connecting edge so that the vortices meet the opposite wall, which is not equipped with vortex generators and which can, for example, be cooled in this way.

Further advantages of the invention, in particular in association with the arrangement of the vortex generators and the introduction of the secondary flow, are described below.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 1*a*, 1*b*, 1*c* and 1*d* show, diagrammatically and in perspective, a representation of a vortex generator with fuel being introduced, in a rear view, in a plan view and in a side view;

FIG. 3 shows, diagrammatically, a "half" vortex generator in perspective;

FIGS. 6, 7, 8 and 9 show, diagrammatically, the arrangement in groups of vortex generators in a rectangular, a circular and an annular combustion chamber.

DESCRIPTION OF THE PREFERRED EMBODIMENTS

Figure 2A:
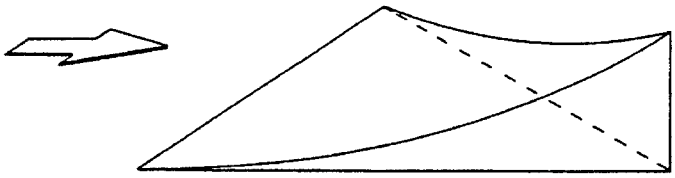
FIGS. 2*a*, 2*b*, 2*c* and 2*d* show, diagrammatically, an embodiment variant of the vortex generator in the same representation without the introduction of fuel.
Figure 2B:
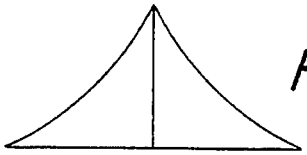
Figure 2C:
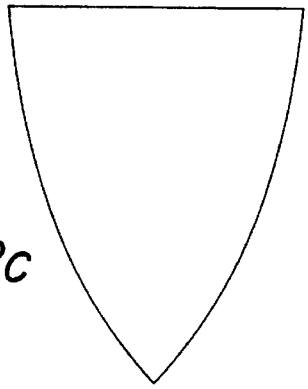
Figure 2D:
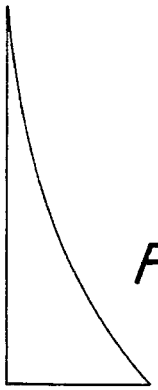

Referring now to the drawings, wherein like reference numerals designate identical or corresponding parts throughout the several views, the actual duct, through which the main flow symbolized by a large arrow occurs, is not represented in FIGS. 1 to 5. As shown in these figures, a vortex generator consists essentially of three triangular surfaces around which flow can take place freely. These are a top surface 10 and two side surfaces 11 and 13. In their longitudinal extent, these surfaces extend at certain angles in the flow direction.

In all the examples shown, the two side surfaces 11, 11v, 11h and 13, 13v, 13h are at right angles to the duct wall 21 butit should be noted that this is not imperative. The longitudinal sides of the side walls, which consist essentially of right-angle triangles in the projection, are fixed to the duct wall 21, preferably in a gas-tight manner. They are oriented in such a way that their short sides form a butt joint and enclose a V-angle α, αv, αh. The butt joint is designed as a sharp connecting edge 16 and is likewise at right angles to the duct wall 21 on which the side surfaces abut. The two side surfaces 11, 11v, 11h and 13, 13v, 13h which enclose the V-angle α, αh, αv are symmetrical in form, size and orientation and are arranged on either side of an axis of symmetry 17 which is located in the duct axis.

An edge 15 of the top surface 10, 10v extends transversely to the duct through which flow takes place and is made very narrow. It is in contact with the same duct wall 21 as the side walls 11, 11v and 13, 13v. Its longitudinally directed edges 12, 14 abut the longitudinally directed side surface edges protruding into the flow duct. The top surface extends at an angle of incidence Θ, Θv to the duct wall 21. Its longitudinal edges 12, 14, together with the connecting edge 16, form a point 18.

The vortex generator can also, of course, be provided with a bottom surface by means of which it is fastened to the duct wall 21 in a suitable manner. Such a bottom surface, however, has no relationship to the mode of operation of the element.

The vortex generators 9 are configured in such a way that the angle of incidence of the top surface and the V-angle of the side surfaces increase in the flow direction.

In the case of FIG. 1, this takes place, on the one hand, by subdivision of the top surface into two partial surfaces 10v, 10h with different incidences (Θv, Θh). On the other hand, the increase in the V-angle of the side surfaces is undertaken by subdividing them into two partial surfaces 11v, 11h, 13v, 13h with different V-angles (αv, αh).

In the case of FIG. 2, the increase in the angle of incidence Θ of the top surface 10 and in the V-angle α of the side surfaces 11, 13 extends continuously to the point 18 from the edge 15 which extends transversely to the duct through which flow takes place.

In all the figures, the connecting edge 16 of the two side surfaces 11, 11*h* and 13, 13h forms the downstream edge of the vortex generator. The edge 15, of the top surface 10, 10v, extending transversely to the duct through which flow takes place is therefore the edge which is met first by the duct flow.

The mode of operation of the vortex generator is as follows. When flow occurs around the edges 12 and 14, the main flow coming from the edge 15 is converted into a pair of opposing vortices. Their vortex axes are located in the axis of the main flow. The swirl number and the location of vortex breakdown are determined by appropriate selection of the angle of incidence Θ and the V-angle α. As these angles increase, the vortex strength and the swirl number are increased and the location of vortex breakdown moves upstream into the region of the vortex generator itself. These two angles Θ and α are specified, depending on the application, by design requirements and by the process itself. It is then only necessary to match the length L of the element and the height h of the connecting edge 16 (FIG. 9).

In FIG. 1, the upstream flow parts of the vortex generator, indicated by v, are set at a low angle of incidence Θv and have a relatively acute V-angle αv. The large-scale vortices necessary for mixing purposes are generated in this way. The down-stream part of the vortex generator is provided with a large incidence Θh and a wide V-angle αh. This provokes the vortex breakdown which is favorable for flame stabilization. As an example, it can be stated that the downstream angles Θh and αh are approximately twice as large as the upstream angles Θv and αv.

On the basis of a vortex generator as shown in FIG. 1, FIG. 3 shows a so-called "half vortex generator" in which only one of the side surfaces of the vortex generator 9 is provided with a V-angle αv/2 and αh/2 which varies in the flow direction. The other side surface is straight and directed in the flow direction. In contrast to the symmetrical vortex generator, there is only one vortex in this case and it is generated on the angled side. In consequence, the field downstream of the vortex generator is not vortex-neutral; swirl is, on the contrary, imposed on the flow.

The vortex generators are used, on the one hand, as mixers of two flows. The main flow, in the form of combustion air, attacks the transversely directed inlet edges 15 in the direction of the arrow. The secondary flow, in the form of a gaseous and/or liquid fuel, has an essentially smaller mass flow than the main flow. It is fed into the main flow in the immediate region of the vortex generators.

The feed arrangement for the gaseous and/or liquid fuel to be mixed into the combustion air in the flow duct can be designed in a variety of ways, as shown in FIGS. 4 to 6*b*.

Figure 4:
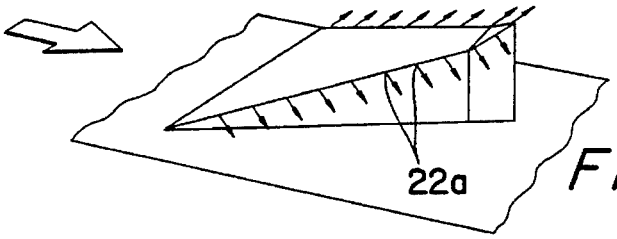
FIGS. 4–5 show, diagrammatically, a plurality of variants for introducing the fuel.

As shown in FIG. 4, the outflow into the combustion air takes place via wall holes 22*a*, which have an echelon arrangement in the longitudinal edges 12 and 14 (or at least in their immediate region). The fuel therefore passes directly into the developing vortex, which rises in the injection region. Defined flow relationships are present in this region.

Figure 5:
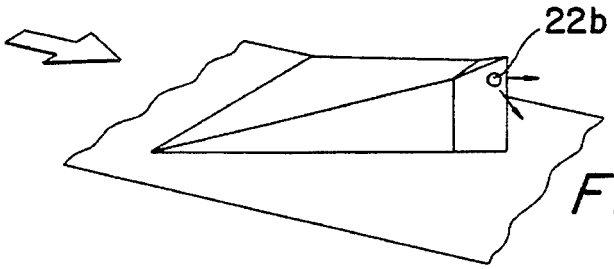

In FIG. 5, the fuel flows from individual holes 22*b* in the region of the point 18 of the vortex generator. In this case, the medium is introduced directly into the fully formed vortex and, specifically, also into its rising branch.

In the variant represented in FIGS. 1*a*, 1*b*, 1*c* and 1*d*, the gas is introduced from wall holes 22*c* which are located in the duct wall 21 along the edge 15 of the vortex generator. The injection angle is selected in such a way (FIG. 1*d*) that the gas flows around the top surface of the vortex generator as a film before it is mixed in. This "cold" film forms a protective layer for the top surface in the case of a hot main flow. The solution shown in FIG. 1 is particularly suitable for dual operation in which both gaseous and liquid fuel are mixed into the main flow and later burned. The liquid fuel, oil in this case, is introduced by means of an individual hole 22*f* which enters directly at the edge 15, preferably at the same injection angle as the gas. This oil is also distributed as a film over the top surface before its atomization in the vortex.

A slot 22*d* (not represented here) can also be used instead of the wall holes 22*c*. This may be seen in FIG. 6*b* which is described later.

FIGS. 6 to 9 show different arrangement variants of the vortex generators described.

In FIG. 6, the combustion chamber duct 20 through which flow takes place is of rectangular shape. It should be noted that the shape of the duct through which flow takes place is not essential to the mode of operation of the invention. Instead of the rectangle shown, the duct could also involve an annular segment, i.e. the walls would be curved. The short boundary walls of the cross-section through which flow takes place would, in this case, be radial ribs which segment the annulus. The above statement that the side surfaces are at right angles to the duct wall must, of course, be considered relatively in such a case. The important point is that the connecting edge. 16 located on the line of symmetry 17 should be at right angles to the corresponding wall. In the case of annular walls, the connecting edge 16 would therefore be directed radially, as is represented in FIG. 8.

In FIG. 6, one vortex generator 9, which extends over the whole of the short side of the rectangle, is arranged on each of the two short sides of the rectangle or, if appropriate, on the radial ribs. In the case of annular ducts, this arrangement i.e. meeting the bottom surface at a corner, has the advantage that the fuel supply and a coolant for the vortex generators could take place from the long walls and does not have to take place via otherwise necessary hollow ribs. In addition, one vortex generator is arranged on each of the two long walls. From the point of view of vortex formation, this configuration is the best possible. It may be recognized from FIG. 6*b* that measures which contribute to a different vortex formation are taken in this case. In the first place, vortex generators of different geometry are used. Furthermore, the connecting edges of the vortex generators on the long side are not arranged in the same plane. This is useful, for example, when space for the accommodation of a central fuel lance has to be provided in the center of the points.

Although the vortex generators in the composite have different heights, their height is at least approximately the same relative to the height of the duct part associated with the corresponding vortex generator. The height h of the connecting edge 16 will, as a rule, be matched to the duct height H in such a way that the vortex generated has already achieved such a size immediately downstream of the vortex generator that the complete duct height H is filled, which leads to an even distribution in the cross-section acted upon by the flow. A further criterion, which can have an influence on the ratio h/H to be selected, is the pressure drop which occurs when flow takes place around the vortex generator. It is obvious that the pressure loss coefficient also increases with a larger ratio of h/H.

For dual operation, the fuel supply takes place in FIG. 6 from the oil and gas conduits 25 which extend in the walls. The introduction into the duct 20 takes place as in the solution described in FIG. 1, in which a slot 22*f* along the edge 15 is provided for the gas, in this case, instead of individual wall holes.

The fuel introduced is entrained by the vortices and mixed with the main flow. It follows the helical course of the vortices and is evenly and finely distributed in the chamber downstream of the vortices. This reduces the danger of streaks impinging on the opposite wall with the formation of so-called "hot spots"—which exists with the radial introduction of fuel into an unswirled flow, as mentioned at the beginning.

Because the main mixing process takes place in the vortices and is substantially independent of the momentum with which the secondary flow is introduced, the fuel injection can be kept flexible and matched to other boundary conditions. As an example, the secondary flow can be introduced with the same momentum over the whole of the load range. Because the mixing is determined by the geometry of the vortex generators and not by the machine load—the gas turbine power in the present example—the burner configured in this way operates in an optimum fashion even under part-load conditions. The combustion process is optimized by matching the fuel ignition delay time and the mixing time of the vortices; this ensures a minimization in the emissions.

In addition, the effective mixing produces a good temperature profile over the cross-section through which flow takes place and, in addition, reduces the possibility of thermo-acoustic instability appearing. The vortex generators act as a damping measure against thermo-acoustic vibrations by their presence alone.

In order to provide additional stabilization of the flame, a diffuser 26—a dump diffuser in the present case—is arranged downstream of the vortex generators in the plane in which ignition (which is not shown) occurs.

In FIG. 7, two "half" vortex generators are symmetrically arranged in a circular combustion chamber. Their straight longitudinal side is in contact with the wall of the cylindrical duct whereas the angled side surface protrudes into the flow. Depending on the design of the vortex generators, it is possible for the vortices generated to form a single vortex filling the circular cross-section downstream, this vortex imposing a swirl on the flow. The introduction of the fuel takes place as in the solution of FIG. 6 by means of a wall slot 22*d* (gas) and a single hole 22*f* (oil) arranged in the center of the edge 15. The path of the fuel until it mixes is represented by means of the arrows, which are self-explanatory.

FIG. 8 shows, in a simplified manner, a combustion chamber with an annular duct 20 through which flow takes place. Equal numbers of vortex generators in accordance with FIG. 2 are arranged adjacent to one another in the peripheral direction on both duct walls 21*a* and 21*b* without any free intermediate spaces in such a way that the connecting edges 16 of two opposite vortex generators are located in the same radials. If the same heights h are assumed for the opposite vortex generators, FIG. 8 shows that the vortex generators on the inner duct ring 21*b* have a smaller V-angle α. In the longitudinal section in FIG. 9, it may be recognized that compensation could be provided for this by a larger angle of incidence Θ if equal-swirl vortices are desired in the inner and outer annular cross-sections. In this solution, two vortex pairs with respectively smaller vortices are generated, as is indicated in FIG. 8, and this leads to a shorter mixing length.

In the case of FIG. 9, the liquid fuel is introduced by means of a central fuel lance 24 whose opening is located downstream of the vortex generators 9 in the region of their point 18. In this example, the introduction of the gaseous fuel takes place in two ways. On the one hand, as is indicated by arrows, it takes place by means of wall holes in the vortex generators themselves in accordance with the method of FIG. 4 and, on the other hand, by means of wall holes 22 in the duct wall 21*b* behind the vortex generators. These wall holes can be supplied by a ring main.

The invention is not, of course, limited to the examples described and shown. With respect to the arrangement of the vortex generators in the composite, many combinations are possible without leaving the framework of the invention. The introduction of the secondary flow into the main flow can also be undertaken in a variety of ways. As a departure from the vortex generators shown in FIG. 8, whose connecting edges are located on the same radials, the connecting edges of two opposite vortex generators could also be offset by half a pitch. This would alter the vortex structure downstream of the vortex generators in such a way that the vortices generated on the same side would then have the same direction of rotation and, under certain circumstances, combine to form a large vortex which fills the complete duct cross-section.

Obviously, numerous modifications and variations of the present invention are possible in light of the above teachings. It is therefore to be understood that within the scope of the appended claims, the invention may be practiced otherwise than as specifically described herein.

What is claimed is:

1. A mixing and flame stabilization appliance in a combustion chamber with premixed combustion in which at least one of a gaseous and liquid fuel is introduced into the combustion air, comprising:

a plurality of vortex generators disposed adjacent to one another over the width or the periphery of a combustion chamber duct through which flow takes place; and means for introducing a fuel into the duct in an immediate region of the vortex generators, wherein each vortex generator has three surfaces projecting into the duct around which flow can take place freely, which surfaces have a longitudinal dimension extending in a flow direction of the duct, one surface forming a top surface and the two others forming side surfaces, wherein the side surfaces abut a duct wall and are mutually oriented at a V-angle which varies in the flow direction, wherein a top surface edge extends transversely to the duct through which flow takes place and is in contact with the same duct wall as the side surfaces, wherein longitudinally directed top surface edges abut longitudinally directed side surface edges protruding into the flow duct, and extend at an angle of incidence to the duct wall, which angle varies in the flow direction, and wherein the two side surfaces are joined at a connecting edge which, together with the longitudinally directed edges of the top surface, forms a point.

2. The mixing and flame stabilization appliance as claimed in claim 1, wherein, in a downstream part of the vortex generator, at least one of the angle of incidence of the top surface and the V-angle of the side surfaces are selected in such a way that a vortex generated by the flow has already broken down in the region of the vortex generator.

3. The mixing and flame stabilization appliance as claimed in claim 1, wherein at least one of the angle of incidence of the top surface and the V-angle of the side surfaces of the vortex generator increases in the flow direction.

4. The mixing and flame stabilization appliance as claimed in claim 3, wherein the top surface comprises two partial surfaces with different angles of incidence with the duct wall, and wherein the side surfaces each comprise two partial surfaces with different V-angles.

5. The mixing and flame stabilization appliance as claimed in claim 3, wherein the top surface is formed with an angle of incidence that increases continuously from the edge extending transversely to the duct through which flow takes place to a downstream end.

6. The mixing and flame stabilization appliance as claimed in claim 1, wherein the connecting edge of the side surfaces extending from the duct wall to the point is shaped to be at least approximately sharp.

7. The mixing and flame stabilization appliance as claimed in claim 1, wherein a ratio between a height of the connecting edge and a duct height is selected so that the vortex generated fills the complete duct height directly downstream of the vortex generator.

8. The mixing and flame stabilization appliance as claimed in claim 3, wherein one of the two side surfaces of each vortex generator is positioned parallel to the flow direction throughout the longitudinal dimension.

9. The mixing and flame stabilization appliance as claimed in claim 1, wherein the two vortex generator side surfaces enclosing the V-angle are arranged symmetrically about an axis of symmetry which extends parallel to a duct axis.

10. The mixing and flame stabilization appliance as claimed in claim 1, wherein the connecting edge of the two side surfaces is positioned as a downstream edge of the vortex generator and the top surface edge extending transversely to the duct through which flow takes place is an upstream edge.

11. The mixing and flame stabilization appliance as claimed in claim 1, wherein said means for introducing a fuel comprises a plurality of wall holes located in the side surfaces of the vortex generator in the region of the longitudinally directed edges of the top surface.

12. The mixing and flame stabilization appliance as claimed in claim 1, wherein said means for introducing a fuel comprises wall holes located in a region of the point of each vortex generator.

13. The mixing and flame stabilization appliance as claimed in claim 1, wherein said means for introducing a fuel comprises a fuel lance having an opening for fuel flow located downstream of the vortex generator adjacent to the point.

14. The mixing and flame stabilization appliance as claimed in claim 1, wherein a diffuser is arranged downstream of the vortex generators for additional flame stabilization.

15. The mixing and flame stabilization appliance as claimed in claim 3, wherein the side surfaces are shaped so that the V-angle increases continuously in the direction of flow.

* * * * *